United States Patent [19]

Primich

[11] 4,422,587

[45] Dec. 27, 1983

[54] MACHINE FOR SLITTING STRIPS OF SHEET MATERIAL

[75] Inventor: Theodore Primich, Merrillville, Ind.

[73] Assignee: Gary Steel Products Corp., Gary, Ind.

[21] Appl. No.: 218,220

[22] Filed: Dec. 19, 1980

[51] Int. Cl.[3] ..... B65H 35/02

[52] U.S. Cl. ..... 242/56.2; 242/68.2

[58] Field of Search ..... 242/56.2–56.7, 242/78.3, 78.6, 78.8, 68.2; 83/401, 407, 425, 426, 428; 428/571–573

[56] References Cited

U.S. PATENT DOCUMENTS 3,891,157 6/1975 Justus ..... 242/56.2

4,170,691 10/1979 Rogers ..... 428/572

4,173,313 11/1979 Rogers ..... 242/56.2

4,285,475 8/1981 Rogers ..... 242/56.2

*Primary Examiner*—Leonard D. Christian

*Attorney, Agent, or Firm*—Burmeister, York, Palmatier, Hamby & Jones

[57] ABSTRACT

A machine for slitting strips of elongated sheet material from a wider roll of the material in which two spaced mandrels are mounted vertically on a frame and the sheet of material extends from the mandrel past a carriage to the second mandrel. The carriage carries two engaging circular knives mounted on the carriage for rotation about vertical axes, the knives engaging opposite sides of the sheet to cut a strip from the upper edge of the sheet. The carriage is provided with a guide to maintain the selected distance from the upper edge of the sheet to the cutting plane of the circular knives.

14 Claims, 8 Drawing Figures

MACHINE FOR SLITTING STRIPS OF SHEET MATERIAL

The present invention relates to devices for cutting or severing one or more strips of material from an elongated wider sheet of strip material. More particularly, it relates to devices utilizing a rotary knife for severing a narrow strip from the edge of a wider strip of elongated sheet material.

It has become conventional practice in many industries to produce sheet material in relatively wide coils and to process the coils to produce a range of products. Different products require strips of different widths, and accordingly it is necessary to divide the coil into relatively narrow strips for a particular product, the width of the narrow strip varying with different products. A slitter is used for this purpose, and utilizes a rotary member or knife which produces the slit as the strip moves down a slitting line. The conventional slitting line uses an uncoiler for the coil of material and a slitter, and generally employs a recoiler to wind up one or more of the smaller strips produced by the slitter. Conventional coil slitting is described in a book by John W. Rogers and William H. Millan entitled *Coil Slitting* published by the Corinthian Press in 1972.

Conventionally, the narrow strips produced by a slitter are recoiled, and stored until ready for use on a production line. At this time, the narrow coils are then placed upon a coil unwinder, and utilized in the particular production line. This practice has the disadvantage of requiring multiple handling and storage of the narrow coil, and further requires rewinding of a narrow strip which places a limitation on the permissible width of a narrow strip. One attempt to overcome these deficiencies in handling slit material has been to recoil the slit material in a single assembly in which each of the smaller coils is secured to one or more adjacent coils on a common axis by means of tabs integral with and extending between adjacent coils. Apparatus for producing such an assembly of coils and for feeding strips of material from one of the coils at a time is disclosed in U.S. Pat. No. 4,173,313 of John W. Rogers dated July 25, 1977. The process described by this patent still requires a roll of sheet material to be uncoiled, run through a multiple slitter, recoiled on a recoiling machine, removed from the recoiling machine and transported to a payoff or feed machine to make the narrow strip available to a production line.

It is an object of the present invention to provide a slitter which can cut narrow strips from a wide coil of strip material and make the narrow strips directly available to a production line.

Conventional multiple slitters receive a wide strip of material in a horizontal plane from a coil unwinder with a horizontal mandrel, and the slitters cut or sever the horizontally traveling strip into a plurality of strips which are then rewound on a rewinder with a horizontal mandrel. It is necessary to separate each of the coils formed by the narrow strips on the horizontal mandrel of the rewinder in order to achieve a tight flat coil, and the strips must fan out from the slitter to the rewinding coils. As a result, it is necessary to provide considerable space between the slitter and the rewinder since the narrow strips can leave the slitter at only a small angle to the central axis of travel of the strip material. Hence, slitting lines known to the prior art have required considerable floor space along the axis of travel of the strip material. It is an object of the present invention to provide a slitter with a uncoiling reel and coiling reel which requires less space than conventional slitters.

It is conventional practice to use different width strips to produce different products, and when a production line is changed from one product to another, the coil feeding the line with the strip material must generally be removed from the mandrel of the unwinder at the beginning of the production line and replaced with a coil of a different width. This requires the storage of coils of different widths, the down time while the coils are changed, and often the storage of the remnant of the coil which was previously on the line. It is one of the objects of the present invention to provide a slitter which is capable of producting slits of different widths, so that a single wide coil of sheet material can be slit to any one of a wide range of widths by simply adjusting the slitter.

Some production lines produce laminated products from a plurality of strips of elongated sheet material, such as gaskets. It is a further object of the present invention to provide two or more strips of the same material from a common coil of the strip material directly to such a production line.

These and further objects of the present invention will be readily apparent from the following specification, particularly when viewed in the light of the drawings, in which.

Figure 1:
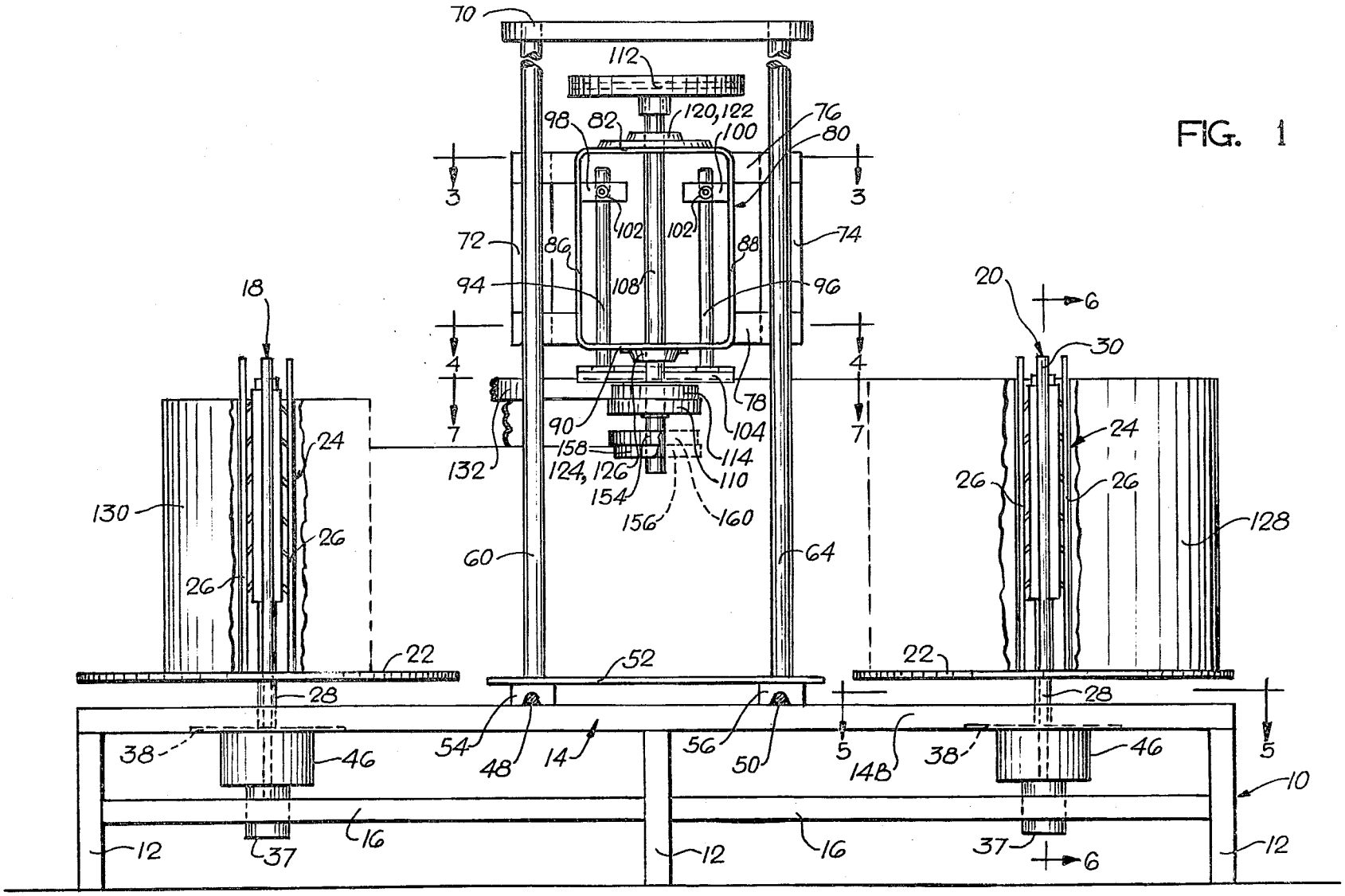
FIG. 1 is a front elevational view of a slitter constructed according to the teachings of the present invention.

The slitter illustrated in the figures has a supporting base 10 constructed of tubular steel. The base 10 has three pairs of equally spaced legs 12 for supporting the base 10 on a horizontal surface. The base 10 includes rectangular frame 14 mounted on one end of the legs 12. Supporting beams 16 extend between adjacent legs 12 to provide a rigid structure. The frame 14 has two parallel elongated side members 14A and 14B which define the axis of elongation of the frame 14, and two end members 14C and 14D which define the transverse axis of the frame.

The frame 14 supports two reels 18 and 20, and the reels 18 and 20 are identical. Each of the reels has a circular support disc 22 and a mandrel 24 which extends normally from the center of the support disc 22. The mandrel 24 is of the expansion type and has a plurality of fingers 26 which extend upwardly about the center of the disc 22 substantially normal to the disc. A motor shaft 28 is mounted on the disc 22 at its center and extends upwardly between the fingers 26. The shaft 28 is hollow, and a pusher rod 30 is translatably disposed within the shaft 28. The pusher rod 30 engages a stop 32 at the end opposite the disc 22, and the stop 32 abuts the end of a sleeve 34, which is disposed between the stop and the disc 22, the sleeve being spaced from the disc. A plurality of links 36 are mounted on the sleeve 34 and each of the fingers 26, and an actuating motor 37 is mounted on the frame 10 and connected to the push rod 30. When the actuating motor 37 is energized, as by hydraulic fluid, the push rod forces the sleeve 34 downwardly causing the links 36 to pivot and force the fingers outwardly to engage a coil of sheet material disposed about the mandrel 24.

Figure 5:
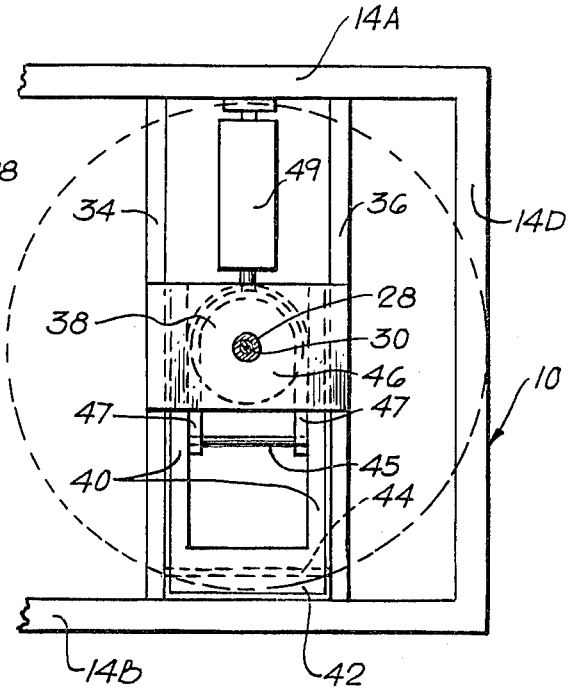
FIG. 5 is a sectional view taken along the line 5—5 of FIG. 1.
Figure 6A:
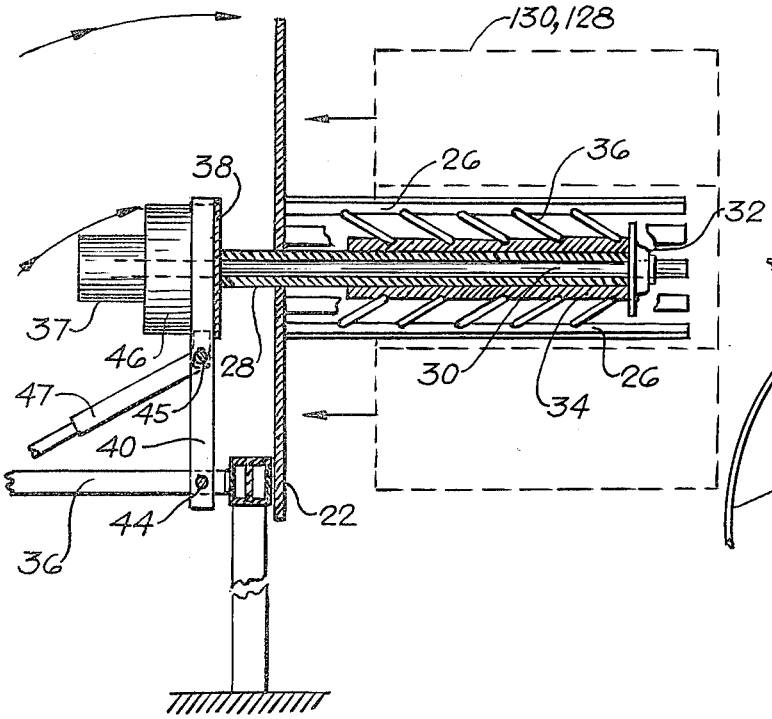
FIG. 6A is sectional view taken in the same plane as FIG. 6 with the axle in loading position.
Figure 7:
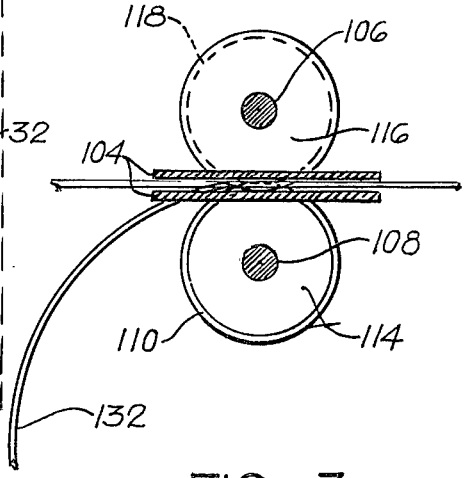
FIG. 7 is a sectional view taken along the line 7—7 of FIG. 1.

Each of the reels 18 and 20 is adapted to be moved from the position illustrated in FIG. 1 to position the mandrels 24 horizontally, as shown in FIG. 6A, in order to facilitate loading and unloading of the coils. As illustrated in FIG. 5, the frame 10 is provided with a pair of parallel struts 34 and 36 adjacent to the rail 14D and extending between the side rails 14A and 14B. A flat plate 38 rests upon the upper surface of the struts 34 and 36, and the plate 38 is mounted at one end of a bifurcated arm 40. The end of the arm 40 opposite the plate 38 has a hub 42, and the hub 42 is journaled on a pin 44 which extends between the struts 34 and 36 adjacent to the side rail 14B. The shaft 28 extends through the plate 38, and a motor 46 is mounted on the lower side of the plate 38 and engages the shaft 28. The reels 18 and 20 are identical in their mounting and drive constructions. A second pin 45 is mounted on the arms 40 parallel to the first pin adjacent to the motor 46, and a bifurcated drive arm 47 of a hydraulic cylinder 49 is pivotally mounted on the pin 45 to provide the drive to pivot the arm 40 into the vertical position shown in FIG. 6A.

A pair of parallel rails 48 and 50 extend between the side beams 14A and 14B perpendicular to the plane of the shafts 28 of the reels 18 and 20. The rails 48 and 50 are mounted in fixed position on the frame 14, the rail 48 being spaced from the disc 22 of reel 18 by the same distance that the rail 50 is spaced from the disc 22 of reel 20. A flat plate 52 is translatably mounted on the rails 48 and 50 by means of bearing blocks 54 and 56 which engage the rails 48 and 50, respectively. The forward side of the plate 52, designated 52A, confronts the rail 14B of the frame 14, and a first pair of parallel guide tubes 58 and 60 are mounted perpendicular to the plate 52 adjacent to the reel 18. A second pair of parallel guide tubes 62 and 64 are disposed adjacent to the forward edge 52A on the side of the plate 52 adjacent to the reel 20. The tubes 58 and 60 are spaced from each other by a distance sufficient to accommodate a sheet of the material to be processed, and the tubes 62 and 64 are spaced by approximately the same distance. The tubes 58 and 60 are generally disposed in the same plane as the guide rail 48, and the tubes 62 and 64 are generally disposed in the same plane as the guide rail 50. A support post 66 is also disposed in the plane of the tubes 58 and 60 and a second support post 68 is disposed in the plane of the tubes 62 and 64. The support posts 66 and 68 are parallel to tubes 58 and 62, and one end of each of the support posts 66 and 68 is mounted on the plate 52. The other end of the support posts 66 and 68 is mounted on a second plate 70 disposed parallel to the plate 52. In like manner, the ends of the guide posts 58, 60, 62 and 64 opposite the plate 52 are mounted on the second plate 70.

The two support posts 66 and 68 carry translatable bearing sleeves 72 and 74, and the sleeves are interconnected at their upper ends by a strip 76 and at their lower ends by a strip 78. The strips 76 and 78 support a housing 80 which extends forwardly from the strips between the guide posts 58, 60 and 62, 64.

The housing 80 is a generally rectangular container open at the front side. It is provided with a top wall 82, a back wall 84, side walls 86 and 88, and a bottom wall 90. The bottom wall 90 and side walls 86 and 88 are provided with a slot 92 which is disposed parallel to the front rail 14B and extends completely through the bottom wall 90 and approximately half way up the side walls 86 and 88. The slot 92 divides the bottom wall 90 into two space sections 90A and 90B, and a pair of spaced parallel rods 94 and 96 extend parallel to the walls 86 and 88 through the slot 92. The rods 94 and 96 are translatably mounted within blocks 98 and 100 which extend inwardly from the upper portions of the walls 86 and 88 of the housing 80, and set screws 102 maintain the rods in fixed position relative to the housing 80. The ends of the rods opposite the blocks 98 and 100 are mounted on a guide 104 in the form of an elongated bar which is disposed parallel to the plate 52 and is adapted to engage the upper edge of a strip of material disposed between the guide rods 58, 60 and 62, 64.

Two parallel shafts 106 and 108 are mounted on the housing 80. The shaft 106 is disposed adjacent to the back wall 84 of the housing 80 and is journaled on the top wall 82 and the portion 90A of the bottom wall. The shaft 108 is journaled on the top wall 82 and the portion 90B of the bottom wall. The shafts 106 and 108 are disposed parallel to the side walls 86 and 88 and the back wall 84.

Both of the shafts 106 and 108 extend from the housing 80 on opposite sides of the guide 104, and the shafts 106 and 108 extend beyond the side of the guide opposite the housing 80. A cylindrical knife 110 is mounted on the end of the shaft 108 below the housing 80, and a hand wheel 112 is mounted on the end of the shaft 108 above the wall 82 of the housing 80. A cylindrical drive washer 114 is also mounted on the shaft 108 above and adjacent to the knife 110, and the cylindrical washer 114 is of slightly smaller diameter than the diameter of the cylindrical knife 110. In like manner, a second cylindrical knife 116 is mounted adjacent to the end of the shaft 106 below the housing 80, and the cylindrical knife 116 is generally aligned with the cylindrical washer 114, and spaced slightly from the cylindrical knife 110. A second cylindrical washer 118 is mounted on the shaft 106 immediately below the cylindrical knife 116, and the cylindrical washer 118 is generally aligned with the cylindrical knife 110. The shafts 106 and 108 are mounted on the top wall 82 of the housing 80 in bearing assemblies 120 and 122, and the shafts 108 and 106 are mounted on the wall 90 in bearing assemblies 124 and 126, respectively.

The figures show a coil 128 mounted on the mandrel 24 of the reel 20. The coil 128 is threaded between the rolls 62 and 64, through the knives 110 and 116, and through the guide rolls 58 and 60. The end of the coil 128 opposite the reel 20 engages the reel 18, and power is applied to the reel 18 by its motor 46 to translate material from the coil 128 to form a new coil designated 130 on the reel 18. As the strip material rolls between the knives 110 and 116, the knives and the washers 114 and 118 engage the surface of the strip material causing the shafts 106 and 108 to rotate with their associated cylindrical knives and cylindrical washers, thus cutting a strip of material from the upper edge of the sheet material passing between the guides, that strip having been designated 132. The remainder of the material passing between the guides 58, 60 and 62, 64 is recoiled on the mandrel of the reel 18 to add to coil 130.

Figure 4:
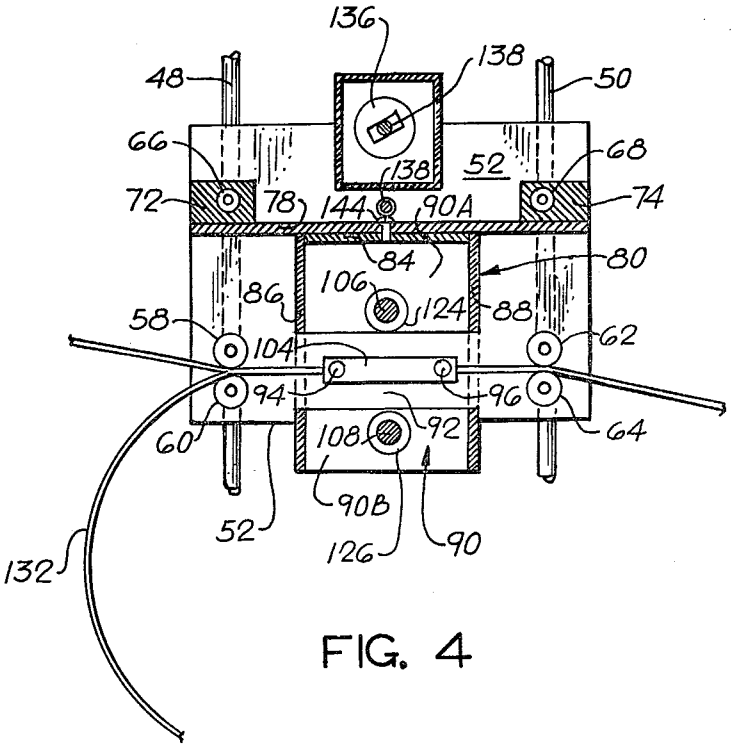
FIG. 4 is a sectional view taken along the line 4—4 of FIG. 1.
Figure 3:
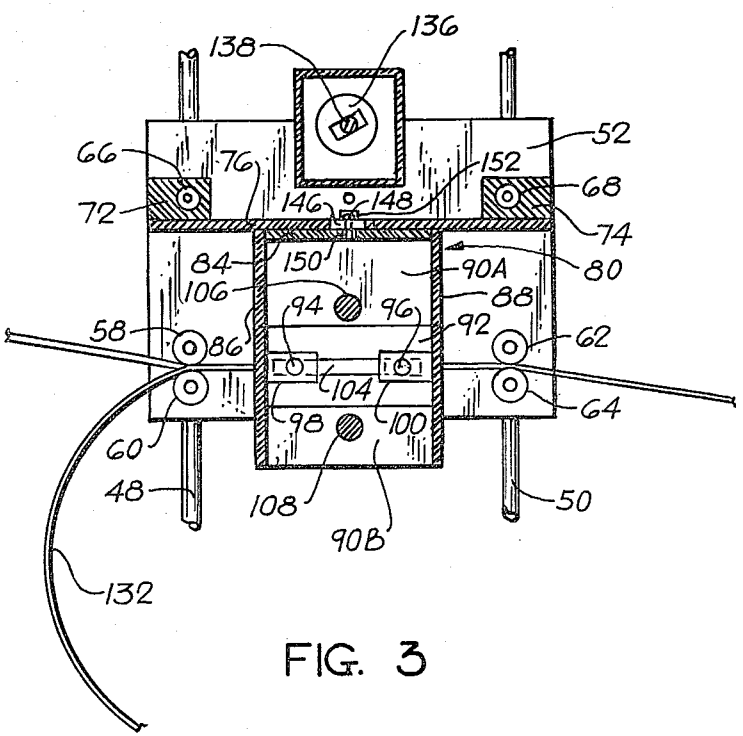
FIG. 3 is a sectional view taken along the line 3—3 of FIG. 1.
Figure 6:
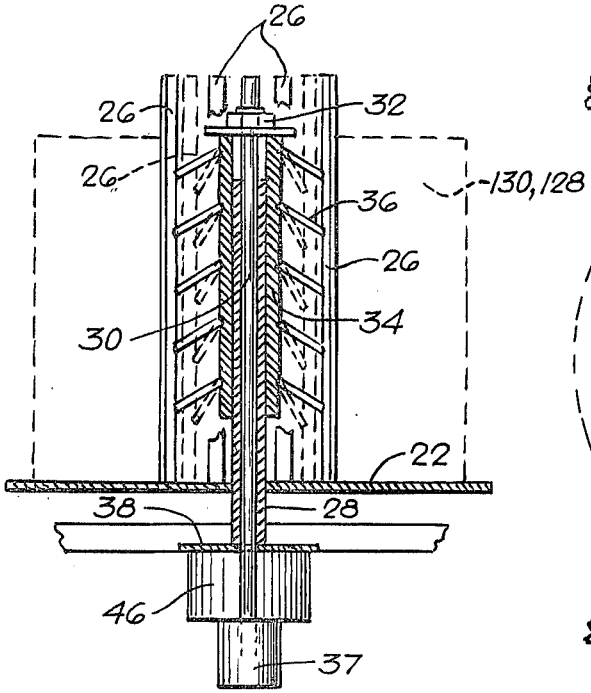
FIG. 6 is a sectional view taken along the line 6—6 of FIG. 1.

The strip 132 which has been severed from the coil is shown in FIGS. 3 and 4 to be looped from the guide roll 60. This strip may be directly processed on a line extending from the slitter generally along the axis of the rails 48 and 50. Further, the plate 52, and the associated guides 58, 60 and 62, 64 are translatable on the rails 48 and 50, so that the position of the plate 52 is determined by the relative diameters of the coils 128 and 130. As illustrated, the coil 128 being processed is of significantly larger diameter than the coil 130 being recoiled on the reel 18, and the guide rolls 58, 60 and 62, 64 thus assume a position substantially midway between the plane parallel to the axes of the mandrels of the reels 18 and 20 coinciding with the perimeter of the coil 130 on the reel 18 and that parallel plane coinciding with the perimeter of the coil 128 on the reel 20.

Figure 2:
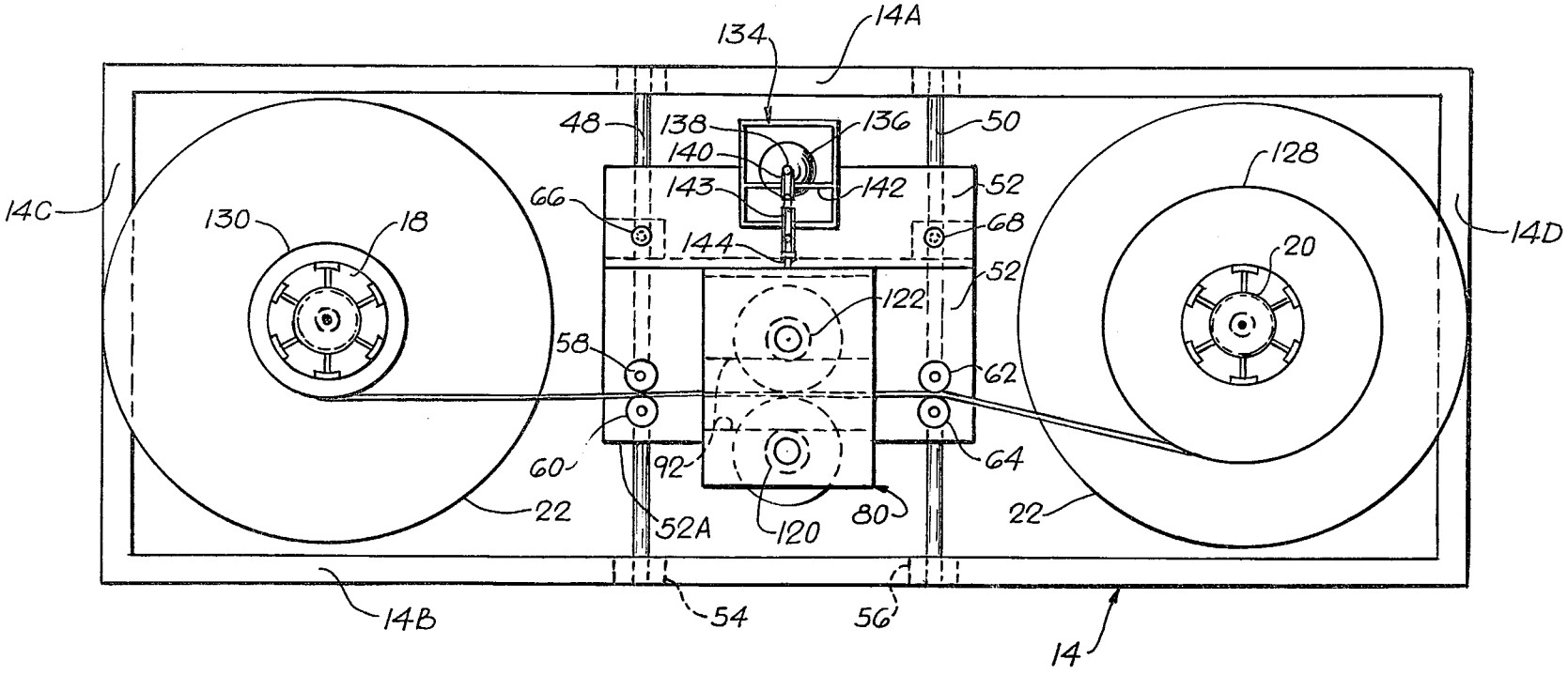
FIG. 2 is a plan view of the slitter of FIG. 1.

The housing 80 is also translatable on the support posts 66 and 68, and yieldable force biasing means associated with the housing provide the proper tension between the guide 104 and the top of the sheet material being transported from the coil 128 to the coil 130. As illustrated in FIG. 2, a hollow rectangular tube 134 is mounted vertically on the plate 52 aligned and back of housing 80. A cylindrical weight 136 is hung within the tube 134 on a cord 138. The cord 138 passes over a pulley 140 mounted on a shaft 142 at the upper edge of the tube 134, and the cord 138 passes over a second pulley 143 on the side of the tube 134 adjacent to the support posts 66 and 68. The cord extends downwardly and is secured at the rear side of the housing 80 on a pin 144.

It is also desirable during operation for the knives 110 and 116 to draw housing 80 toward the sheet material being cut. For this reason, the housing 80 is provided with angular adjustment. The pin 144 extends through the strip 78 into the rear wall 84 of the housing and forms a pivotal axis for the housing, as indicated in FIG. 4. The strip 76 is provided with an elongated slot 146 generally normal to the axes of the support posts 66 and 68, and a set screw 148 extends through the slot 146 and is threaded in a bore 150 in the back wall 84 of the housing. The set screw 148 has a cap 152 which engages the surface of the strip 76 to lock the housing in position. In this manner, the housing may be pivoted to provide an angle of up to 10° between axis of travel of the upper edge of the strip material being cut and the plane of the surface of the cylindrical knives 110 and 116.

Since both reels 18 and 20 are provided with a driving motor 46, the coil 128 may be transported from the reel 20 to the reel 18 removing the strip 132. Thereafter, the end of the coil on the reel 130 may be rethreaded between the guides 58, 60 and 62, 64 and the knives 110 and 116, and power may be applied to the reel 20 to translate the sheet material from the coil 130 the coil 128 and to remove a second strip from the top of the transported material. It is generally necessary to also adjust the angle of the housing 80 when reversing the direction of the material. A second pair of knives may be mounted on the shafts 106 and 108 to remove two strips at a single pass of the material from one of the coils 18, 20 to the other. FIG. 1 illustrates in dashed lines such a second pair of knives 154, 156 and washers 158 and 160 mounted on the shafts 106, 108.

The slitting device illustrated in the figures will be recognized as incorporating an uncoiler, a slitter, and a recoiler. All three units are disposed in close proximity, and it is only necessary to space the mandrels 18 and 20 from the guide rails 48 and 50 by a distance slightly greater than the diameter of the largest coil of sheet material to be processed, a distance of 3" having been found to be sufficient. Further, the slitter illustrated in the figures may be utilized to slit mild steel strips, aluminum strips, copper stripping, and other metals, plastics and fibrous materials. A coil of material may be utilized to remove strips of different widths from the upper edge thereof when traveling in either direction between the mandrels 18 and 20, and the coil need not be removed from the mandrel to change the width of the strip, or to reverse the direction of movement of the strip. Further, the motor drive 46 for the mandrels 18 or 20 may be synchronized with the drive for a production line to assure a supply of narrow strip material synchronized with the demands of the production line.

Those skilled in the art will develop uses and adaptions for the present invention beyond those set forth herein. It is therefore intended that the scope of the present invention be not limited by the foregoing specification, but rather only by the following claims.

The invention claimed is:

1. A device for slitting a narrow strip from a wider coil of elongated strip of sheet material comprising, in combination:

a frame, a first mandrel and a second mandrel, said mandrels being adapted to receive the coil of sheet material, means for mounting the first mandrel and second mandrel at spaced locations along an axis on the frame, said first mandrel and second mandrel being rotatable with respect to the frame about parallel spaced axes, a carriage, means for mounting the carriages on the frame between the first mandrel and second mandrel for translation along an axis of elongation normal to the axis between the first mandrel and the second mandrel, a pair of shafts, means for mounting the shafts on the carriage for rotation about spaced parallel axes, said shafts being generally parallel to the axes of the first and second mandrel, a first circular knife mounted on one shaft of said pair for rotation about the center thereof in a plane normal to the one shaft and a second circular knife mounted on the other for rotation about the center thereof in a plane normal to said other shaft of said pairs, the perimeter of said knives being adjacent to each other to form a cutting interface, means for positioning said knives at a controlled position between the frame and the edge of the elongated strip opposite the frame, and means for translating the elongated strip from one mandrel to the other mandrel.

2. A device for slitting a narrow strip from a wider coil of elongated strip material comprising the combination of claim 1 wherein the means for mounting the first mandrel and second mandrel on the frame positions the mandrels vertically, and the means for positioning the knives comprises a housing mounted on the carriage for translation along a vertical axis, the pair of shafts being mounted on the housing, and a guide mounted on the housing and disposed on the side of the knives opposite the frame, said guide being adapted to ride on the upper edge of the strip of sheet material.

3. A device for slitting a narrow strip from a wider coil of elongated strip material comprising the combination of claim 2 wherein the guide comprises an elongated straight bar with a straight groove on the side thereof opposite the housing adapted to translatably accommodate the upper edge of the strip of elongated strip material.

4. A device for slitting a narrow strip from a wider coil of elongated strip material comprising the combination of claim 2 wherein the means for mounting the first mandrel on the frame is provided with a controllable positioning device for positioning the first mandrel either in the vertical position or in a substantially horizontal position.

5. A device for slitting a narrow strip from a wider coil of elongated strip material comprising the combination of claim 2 wherein the carriage includes a first pair of parallel spaced guide tubes mounted on the carriage disposed parallel to the first mandrel, said first pair of tubes being disposed between the knives and the first mandrel and being adapted to accommodate the elongated strip in the space between the guide tubes.

6. A device for slitting a narrow strip from a wider coil of elongated strip material comprising the combination of claim 5 wherein the carriage includes a second pair of parallel spaced guide tubes mounted on the carriage disposed parallel to the second mandrel, said second pair of tubes being disposed between the knives and the second mandrel and being adapted to accommodate the elongated strip in the space between the guide tubes.

7. A device for slitting a narrow strip from a wider coil of elongated strip material comprising the combination of claim 1 wherein the first circular knife and the second circular knife are cylindrical in form, in combination with a first cylindrical washer of smaller diameter than the first circular knife mounted coaxially on the other shaft for rotation therewith confronting the first circular knife, and a second cylindrical washer of smaller diameter than the second circular knife mounted coaxially on the one shaft for rotation therewith confronting the second circular knife, the first knife and first washer being adapted to engage the elongated strip and the second knife and second washer being adapted to engage the elongated strip therebetween.

8. A device for slitting a narrow strip from a wider coil of elongated strip material comprising the combination of claim 1 wherein the means for mounting the shafts on the carriage includes means for setting the angle of the first and second shafts with respect to the axes of the first and second mandrel.

9. A device for slitting a narrow strip from a wider coil of elongated strip material comprising the combination of claim 1 wherein the means for translatably mounting the carriage on the frame comprises a pair of parallel spaced rails disposed between the first mandrel and the second mandrel normal to the axis between the first and second mandrels, the carriage being translatably mounted on the pair of rails.

10. A device for slitting a narrow strip from a wider coil of elongated strip material comprising the combination of claim 1 wherein the means for mounting the pair of shafts on the carriage comprises a housing having a top and a bottom, each shaft of the pair of shafts extending from the top and through the bottom and being journaled on the top and bottom of the housing, and means for mounting the housing on the carriage.

11. A device for slitting a narrow strip from a wider coil of elongated strip material comprising the combination of claim 10 wherein the means for mounting the housing on the carriage comprises a pin mounted on the housing and the carriage, said pin being disposed on an axis in the plane of the pair of shafts and normal to the shafts of said pair, and said housing being pivotal with respect to the carriage about said axis.

12. A device for slitting a narrow strip from a wider coil of elongated strip material comprising the combination of claim 11 wherein the housing is provided with a slot in the bottom thereof between the shafts of the pair of shafts to permit the elongated sheet of strip material to extend into the housing.

13. A device for slitting a narrow strip from a wider coil of elongated strip material comprising the combination of claim 2 in combination with means for compensating for the force of the guide on the edge of the elongated strip.

14. A device for slitting a narrow strip from a wider coil of elongated strip material comprising the combination of claim 13 wherein the means for compensating for the force of the guide on the elongated strip comprises a weight, a pulley mounted on the carriage above the housing, and a cord connected to the weight and the housing and extending over the pulley.

* * * * *